US006967343B2

(12) United States Patent
Batten et al.

(10) Patent No.: US 6,967,343 B2
(45) Date of Patent: Nov. 22, 2005

(54) CONDENSED TUNGSTEN COMPOSITE MATERIAL AND METHOD FOR MANUFACTURING AND SEALING A RADIATION SHIELDING ENCLOSURE

(75) Inventors: Patrick A. Batten, Ft Collins, CO (US); Troy C. Schank, Atlanta, GA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/280,905

(22) Filed: Oct. 25, 2002

(65) Prior Publication Data

US 2004/0079904 A1 Apr. 29, 2004

(51) Int. Cl.[7] ..... G21F 1/00
(52) U.S. Cl. ..... 250/515.1; 250/505.1; 250/506.1
(58) Field of Search ..... 250/515.1; 257/659; 378/142

(56) References Cited

U.S. PATENT DOCUMENTS

| | | | | |
|---|---|---|---|---|
| 5,889,316 | A * | 3/1999 | Strobel et al. | 257/659 |
| 5,908,884 | A * | 6/1999 | Kawamura et al. | 523/136 |
| 6,048,379 | A | 4/2000 | Bray et al. | |
| 6,166,390 | A | 12/2000 | Quapp et al. | |
| 6,215,852 | B1 * | 4/2001 | Rogers et al. | 378/142 |
| 6,310,355 | B1 | 10/2001 | Cadwalader | |
| 6,372,157 | B1 | 4/2002 | Krill et al. | |
| 6,455,864 | B1 * | 9/2002 | Featherby et al. | 250/515.1 |

* cited by examiner

*Primary Examiner*—John R. Lee
*Assistant Examiner*—Paul M. Gurzo
(74) *Attorney, Agent, or Firm*—Cynthia S Mitchell

(57) ABSTRACT

Materials and methods of manufacturing radiation shielded enclosures is presented that may replace the use of lead, granite and other undesirable materials and manufacturing methods. The present invention provides a high-density radiation shielding enclosure manufactured using a fiber-glass lay-up or pressure spaying process and tungsten powder. The method of manufacture may include applying a tungsten powder in an epoxy, caulking, sealant, adhesive or elastomeric compound to the radiation shielding enclosure in order to seal any cracks, holes, joints or other radiation leaks.

12 Claims, 5 Drawing Sheets

CONDENSED TUNGSTEN COMPOSITE MATERIAL AND METHOD FOR MANUFACTURING AND SEALING A RADIATION SHIELDING ENCLOSURE

FIELD OF THE INVENTION

The present invention pertains generally to the field of radiation shielding, and more particularly to materials and methods of manufacturing radiation shielding enclosures and sealing radiation leaks in radiation shielding enclosures.

BACKGROUND OF THE INVENTION

There are numerous uses for an x-ray shielding container, such as medical x-ray machines and industrial vision inspection machines. For example, x-ray detection is used to image dense objects, such as human bones, that are located within the body. Another application of x-ray detection and imaging is in the field of non-destructive electronic device testing. For example, x-ray imaging is used to determine the quality of solder that is used to connect electronic devices and modules to printed circuit boards.

X-ray imaging works by passing electromagnetic energy at wavelengths of approximately 0.1 to $100\times10^{-10}$ meters (m) through the target that is to be imaged. The x-rays are received by a receiver element, known as an x-ray detector, on which a shadow mask that corresponds to the objects within the target is impressed. Dark shadows correspond to dense regions in the target and light shadows correspond to less dense regions in the target. In this manner, dense objects, such as solder, which contains heavy metals such as lead, can be visually distinguished from less dense regions. This allows the solder joints to be inspected easily.

X-ray radiation is dangerous to living beings and the environment. Therefore, x-ray equipment is typically contained within an x-ray shielding container.

The shielding containers in x-ray applications have typically been built from welded steel frames with plates of lead or sheets of granite attached for shielding. Plate lead shielding is very expensive and the sheets of lead are difficult to attach to an enclosure to form a shielded enclosure. A lead enclosure typically requires steel or other exterior enclosure to protect the lead shielding from damage. Lead is also a highly toxic material, making its use in medical, industrial and commercial settings undesirable. It is also very difficult to seal holes, cracks, joints, seams and other leak points in a lead enclosure.

Although granite is not a toxic material, granite-shielding enclosures suffer many of the same shortcomings as lead shielding enclosures. Granite is also very heavy and difficult to manufacture and work with. As most radiation leakage will occur around seams, joints or holes, granite must be worked with in large sheets for large medical and industrial enclosures. This makes working with and transporting a granite enclosure very difficult due to the weight of the enclosure. Moreover, granite composites typically have poor radiation shielding characteristics.

Accordingly, there exists a need for an environmentally safe, low cost, lightweight radiation shielding enclosure with good radiation shielding properties. In particular, a need exists for a radiation shielding enclosure made of a shielding material other than lead or granite.

SUMMARY OF THE INVENTION

An apparatus for enclosing and shielding x-ray imaging and inspection equipment using tungsten rather than lead or granite is provided. The radiation shielding enclosure may be manufactured with a lay-up process using condensed tungsten powder in an epoxy or polyester substrate and fiberglass or other fabric sheet material to cover a form of the enclosure and/or to provide structural reinforcement.

The radiation shielding enclosure may also be manufactured with a pressure spray process using condensed tungsten powder, cut fibers and an epoxy, polyester, or other suitable substrate capable of being pressurized and sprayed onto a form of the enclosure. A method for sealing cracks, seams, holes and leaks in an x-ray equipment container is provided.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
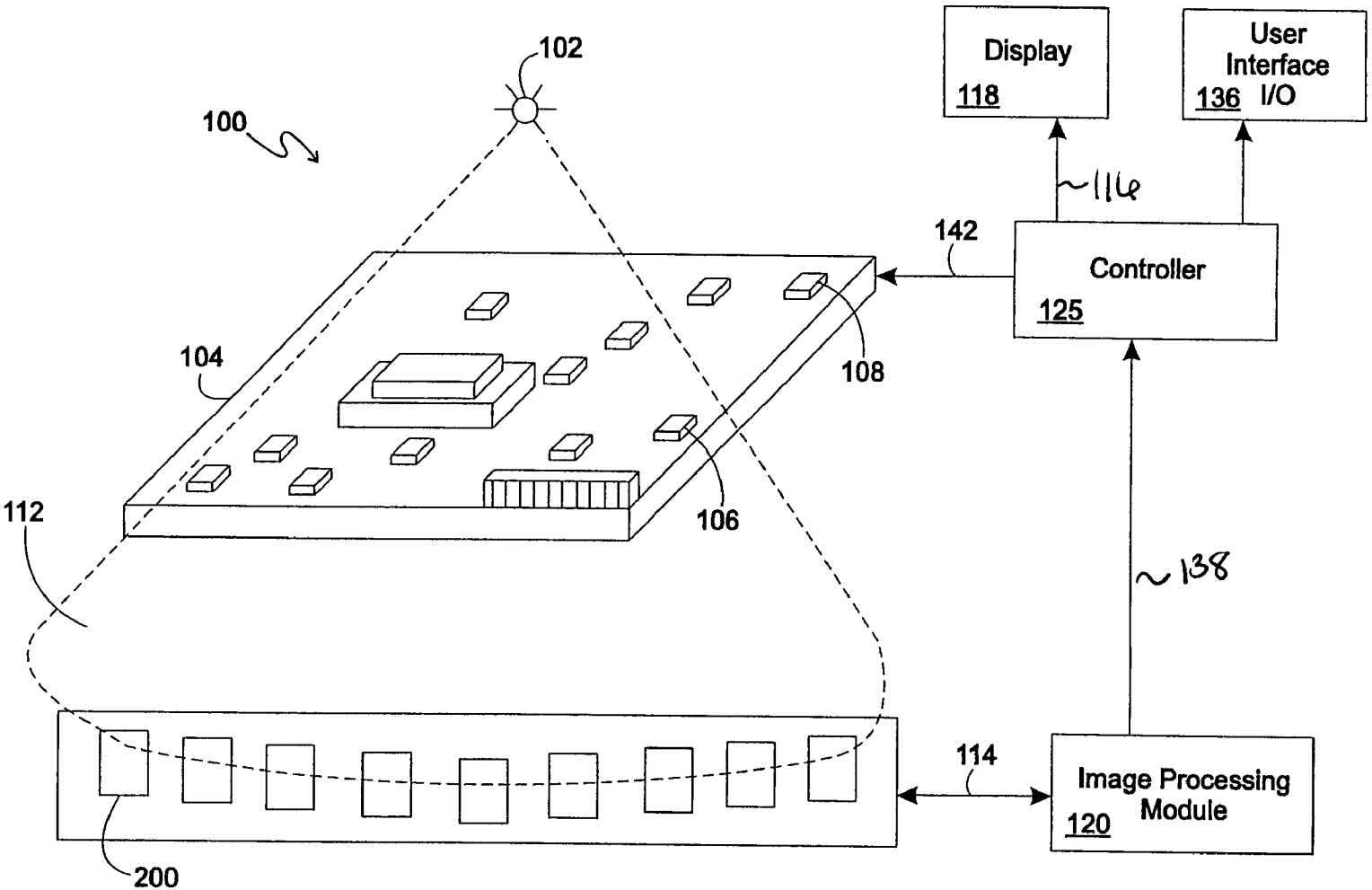
FIG. 1 is a schematic diagram illustrating an exemplary x-ray imaging system.

As shown in the drawings for purposes of illustration, the present invention relates to techniques for providing a radiation shielding enclosure. While described below with particular reference to an x-ray imaging system and with particular illustration of an x-ray imaging system for inspecting solder on printed circuit boards (PCB), embodiments of the invention are applicable in other x-ray systems.

Turning now to the drawings, FIG. 1 illustrates an exemplary x-ray imaging system 100 in which an x-ray detector 200 resides. The x-ray imaging system 100 includes an x-ray source 102 and a plurality of x-ray detector assemblies, an exemplary one of which is illustrated using reference numeral 200. A plurality of x-ray detectors 200 is typically supported on an x-ray detector assembly fixture (hereinafter detector fixture) 110.

The x-ray detectors 200 and the detector fixture 110 are coupled to an image-processing module 120 via connection 114. The image-processing module 120 is coupled to a controller 125 via connection 138. Each image-processing module 120 may receive input from one or more x-ray detectors, depending on the desired processing architecture.

A controller 125 is coupled to the image-processing module 120 via connection 138. The local interface 138 may be, for example, but not limited to, one or more buses or other wired or wireless connections, as known to those having ordinary skill in the art. The local interface 138 may have additional elements, which are omitted for simplicity, such as buffers (caches), drivers, and controllers, to enable communications. The user interface 136 may be any known or developed I/O device or user interface, such as, a keyboard, a mouse, a stylus or any other device for inputting information into the controller 125.

The controller 125 may be coupled to a display 118 via connection 116. The display 118 receives the output of the controller 125 and displays the results of the x-ray analysis.

In operation, the x-ray imaging system 100 can be used, for example, to analyze the quality of solder joints formed when components are soldered to a printed circuit board (PCB). For example, a PCB 104 includes a plurality of components, exemplary ones of which are illustrated using reference numerals 106 and 108. The components 106 and 108 are generally coupled to the PCB 104 via solder joints. The x-ray imaging system 100 can be used to inspect and determine the quality of the solder joints. Although omitted for simplicity, the PCB 104 may be mounted on a movable fixture that is controlled by the controller 125 to position the PCB 104 as desired for x-ray analysis.

The x-ray source 102 produces x-rays generally in the form of an x-ray radiation pattern 112. The x-ray radiation pattern 112 passes through portions of the PCB 104 and impinges on an array of x-ray detectors 200. As the x-rays pass through the PCB 104, areas of high density (such as solder) appear as dark shadows on the x-ray detectors 200, while areas of less density (such as the material from which the PCB is fabricated), appear as lighter shadows. This forms a shadow mask on each x-ray detector 200 corresponding to the density of the structure through which the x-rays have passed. Although omitted for simplicity, the controller 125 also controls the x-ray source.

As will be described in further detail below, each x-ray detector 200 is constructed and located within the x-ray imaging system 100 so as to receive the x-ray energy from the x-ray source 102 after it passes through the PCB 104 or other target to be analyzed, examined, or radiated, such as food, living tissue, humans or animals. The x-ray detector 200 converts the x-ray energy to an electrical image signal that is representative of the shadow mask that falls on the x-ray detector 200. The electrical image signals from all of the x-ray detectors 200 are sent to the controller 125. The image processing module processes the signals, which can then be provided as an output to the display 118.

It will be readily appreciated that the present x-ray imaging system 100 is a high level representation of an x-ray imaging system for purposes of example only. Other x-ray imaging system configurations 100 and other targets 104 for analysis, examination or radiation are anticipated, such as flesh, humans, animals, food, mail, etc.

Generally, it is desirable to contain the x-rays within an enclosure. This is because x-rays tend to degrade certain electronic devices and are hazardous to living creatures and the environment.

Figure 2:
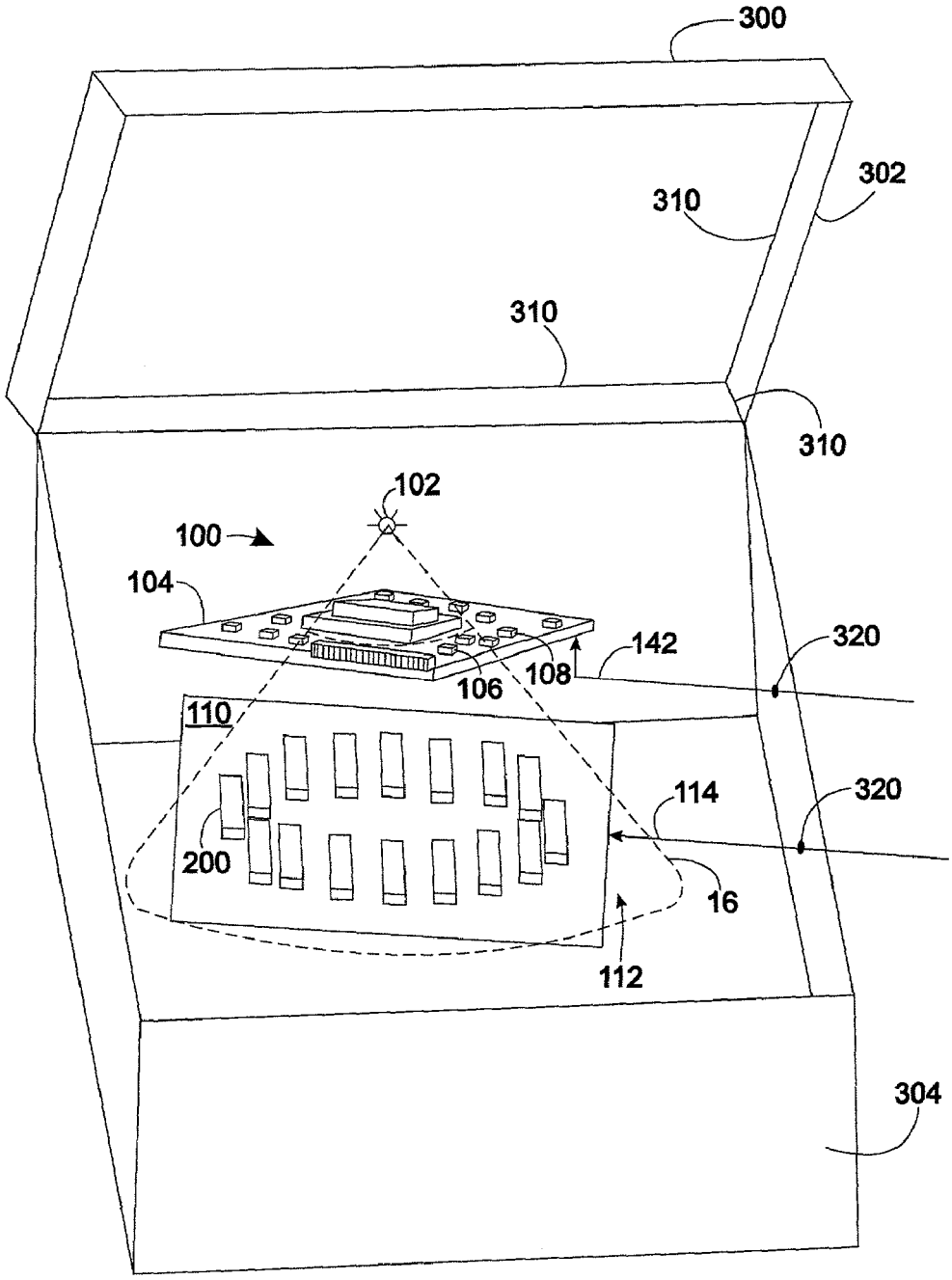
FIG. 2 illustrates a radiation shielding enclosure in accordance with the invention.

FIG. 2 shows a radiation shielding enclosure 300 of tungsten composite with main body 304 and lid 302. Radiation shielding enclosure 300 may have joints 310, sealed with a tungsten composite compound and input/output holes 320, sealed with a tungsten composite compound. FIG. 2 shows an x-ray imaging system 100, such as an x-ray imaging printed circuit inspection system. X-ray imaging system 100 is shown merely for example purposes. Other industrial, manufacturing, and medical radiation emitting systems may be enclosed and shielded with the tungsten radiation shielding enclosure 300 of the present invention.

Figure 3:
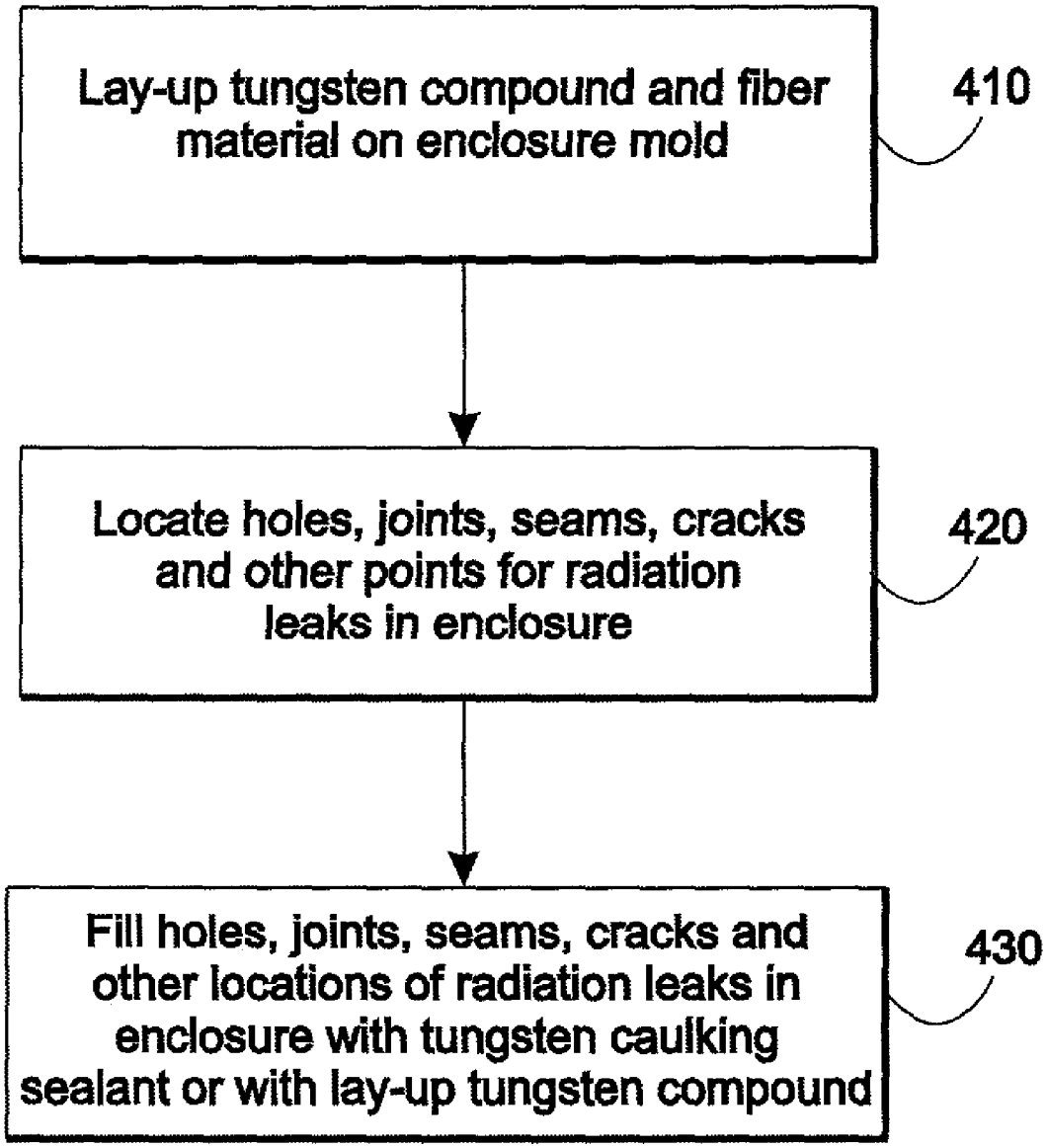
FIG. 3 illustrates a flow chart of a process for forming a radiation shielding enclosure in accordance with one embodiment of the invention.

FIG. 3 shows a flow chart for a manufacturing process according to a first embodiment of the present invention. A lay-up process 410 is used on a form to make a tungsten compound and fiber material radiation shielding enclosure. The tungsten compound may be powder tungsten and resin, polyester or epoxy substrate. The tungsten material used in the compound is a condensed form of tungsten powder. Most commercially available tungsten powders are precipitates, which do not have the high-density property of solid tungsten. Therefore the powder must be pressure and heat formed or sintered into a solid material and then returned to the powdered form by means of grinding, cutting, or a similar process. This allows the compound to use the highest possible density tungsten powder and increases the shielding ability of the compound. The tungsten compound may contain any physically similar polymerized synthetic or chemically modified natural resins including thermoplastic materials such as polyethylene and thermosetting materials such as polyesters that are used with stabilizers and other components to form plastics. The substrate may be formed by air, heat, or UV curing or thermosetting. The fiber may be any fabric material, such as a mesh or fabric form of fiberglass. The enclosure 300 may be a one-piece enclosure formed with the fiberglass fabric material and the tungsten compound using a hand lay-up process on a mold, similar to that used in the boat hull manufacturing industry or the swimming pool industry. The tungsten compound may be thermosetting or air-drying.

This process permits the radiation enclosure to be more environmentally friendly than a lead radiation shielding enclosure 300 by using nontoxic materials. The tungsten radiation shielding enclosure 300 also has cheaper material, shipping and manufacturing costs than most other radiation shielding enclosures. This process of manufacture also reduces the fasteners and adhesives used in manufacturing a radiation shielding enclosure, providing an integrated shielding enclosure with fewer seams, butt joints, overlaps, or holes which require additional processes and parts to shield.

Next, any cracks, joints, worm holes, rivet holes or other material mis-fit areas 310 or 320 where radiation may leak from the structure may be filled by an air or thermosetting tungsten compound 430. The tungsten compound may contain tungsten powder and an epoxy, caulk, sealant, sealant or other known elastomeric material. Once an x-ray imaging system or other radiation system is installed in the tungsten radiation shielding enclosure 300, any power cords, input/output cables or other devices that need to protrude or extend through the radiation shielding enclosure 300 may be threaded through any necessary holes in the enclosure and the tungsten sealing compound may be used to seal around any such cable holes in the radiation shielding enclosure 300. Radiation leaks in the radiation shielding enclosure may also be sealed using a tungsten powder in an epoxy or polyester substrate with a fiberglass lay-up method, rather than with the tungsten sealant/caulking method.

Figure 4:
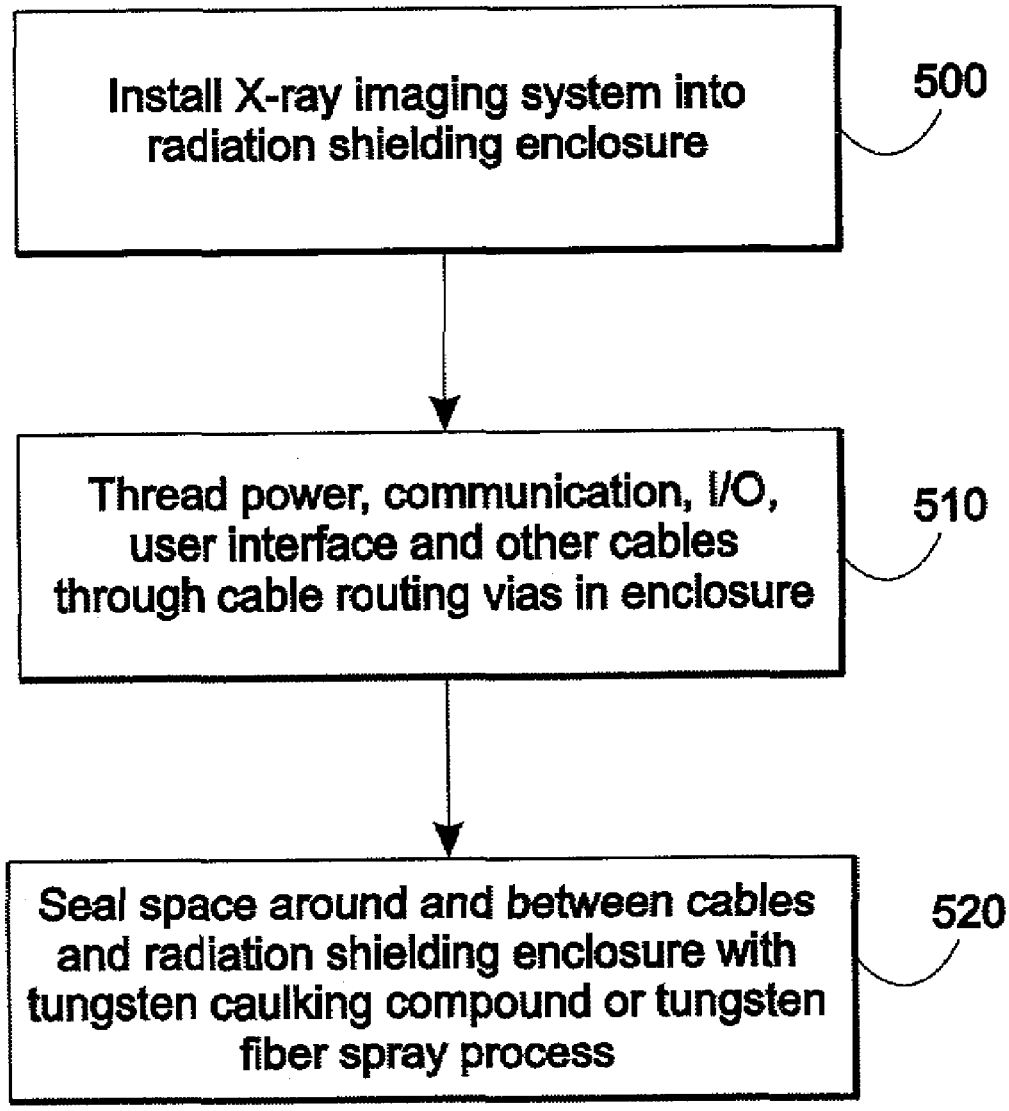
FIG. 4 illustrates a flow chart of a process for sealing radiation leaks in a radiation shielding enclosure in accordance with the present invention.

With reference to FIG. 4 illustrates a flow chart for filling radiation leaks in a radiation shielding enclosure in accordance with the present invention. An x-ray imaging system 100 is installed 500 into the radiation shielding enclosure 300. Any power, communication, I/O, signal or other cables 142, 114 are routed 510 through cable routing vias 320 in the radiation shielding enclosure 300. The void space between any cables 142, 114 and cable routing vias 320 in the radiation shielding enclosure 300 are sealed with a tungsten/ fiber caulking sealant compound. The tungsten/fiber caulking sealant compound may contain tungsten powder and any known elastomeric, epoxy, sealant, caulking or other similar material and is applied in a wet solution and allowed to air dry. Alternatively, the void space between cables 142 and 114 and cable routing vias 320 may be sealed with a tungsten/cut fiber compound by means of a pressure spray process.

Figure 5:
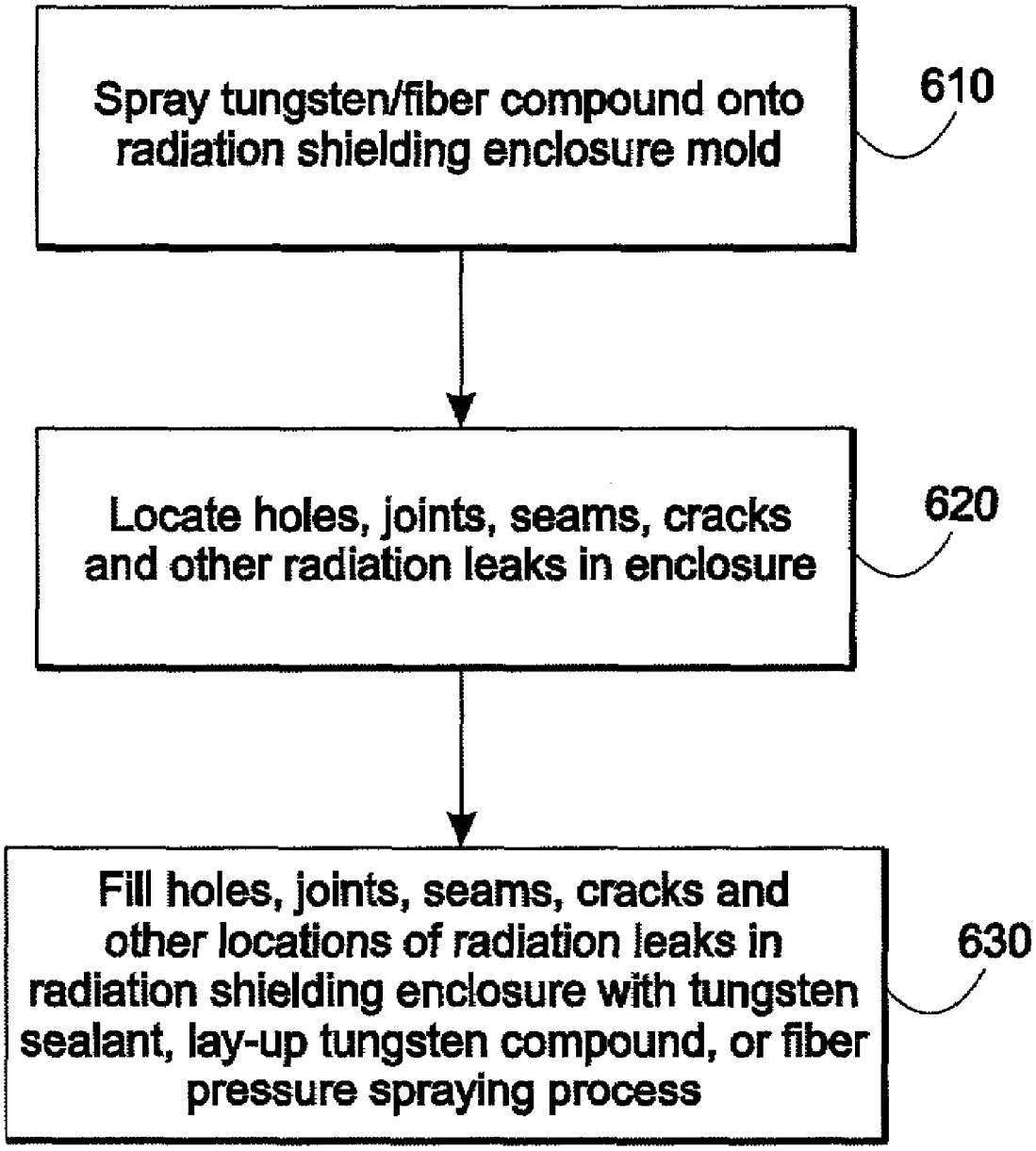
FIG. 5 illustrates a flow chart of a process for forming a radiation shielding enclosure in accordance with a second embodiment of the invention.

Referring now to FIG. 5 a flow chart for a method of manufacturing a radiation shielding enclosure 300 according to a second embodiment of the present invention. A tungsten/fiber compound is pressure sprayed 610 onto a radiation shielding enclosure mold. The tungsten/fiber compound may contain tungsten powder and cut fibers such as fiberglass in an epoxy or polyester substrate capable of pressure spraying and thermosetting or air-drying. Next, any radiation leaks are located 620 and sealed by means of tungsten caulking sealant, tungsten compound in a lay-up process or by means of tungsten/fiber pressure spraying process 630.

Installing an x-ray imaging system into the radiation shielding enclosure, routing cables through cable vias and filling voids may then be done as described above and in FIG. 4.

It will be appreciated from the above detailed description that a mesh, cloth or foil cloth of nylon, polyester, polyethylene, glass compound polyester, metal cloth, carbon fiber cloth, fiberglass cloth, stainless steel fiber, glass fiber reinforced plastic, braided sleeve material or other known cloth material may be used with a tungsten powder in an epoxy, polyester substrate, polymeric binder, nylon 12.RTM, resin, plastic or other known air drying or thermosetting type binder material capable of being used in a lay-up type process. The relative amount of tungsten powder used in the tungsten compound will determine the radiation shielding characteristics of the radiation shielding enclosure, but is preferably 5–95 percent of the tungsten compound by weight. The tungsten powder is preferably 2–40 microns in diameter.

Although this preferred embodiment of the present invention has been disclosed for illustrative purposes, those skilled in the art will appreciate that various modifications, additions and substitutions are possible, without departing from the scope and spirit of the invention, resulting in equivalent embodiments that remain within the scope of the appended claims. For example, the tungsten lay-up process may be used to seal cracks, holes, joints, screw or rivet holes or other material mis-fit areas of a conventional lead or other radiation shielding enclosure or to manufacture an entire, integral enclosure using a mold and lay-up process.

What is claimed is:

1. An x-ray imaging system, comprising:

an x-ray source for imaging a target;

a detector for detecting an imaged target;

a radiation shielding enclosure constructed of a tungsten compound and a fiber material, said radiation shielding enclosure substantially enclosing said x-ray imaging system, said detector and said target, said radiation shielding enclosure configured to open and close for insertion and removal of a target to be imaged; said radiation shielding enclosure is configured to substantially shield x-ray emission while said x-ray imaging system receives and outputs power and data signals to one or more devices external to said radiation shielding enclosure while said x-ray imaging system is operating and said radiation shielding enclosure is closed, wherein said x-ray imaging system is an x-ray inspection machine configured to contain and image said target to be inspected.

2. A system in accordance with claim 1, wherein said tungsten compound contains condensed tungsten powder.

3. A system in accordance with claim 2, wherein said tungsten compound contains an epoxy or polyester material.

4. A system in accordance with claim 2, wherein said fiber material is a fiberglass fabric material.

5. A system in accordance with claim 1, wherein holes, seams, cracks or joints in said radiation shielding housing are filled with a tungsten epoxy sealant.

6. A system in accordance with claim 5, wherein said tungsten epoxy sealant contains condensed tungsten powder.

7. A system in accordance with claim 5, wherein said tungsten epoxy sealant contains an elastomeric material.

8. A system in accordance with claim 5, wherein said tungsten sealant contains an epoxy, adhesive, sealer, caulk or similar material.

9. A system in accordance with claim 5 further comprising one or more holes in said radiation shielding housing for input, output and power supply cords to said x-ray imaging system, wherein a tungsten sealant is used to seal said one or more holes around said input, output and power supply cords.

10. A system in accordance with claim 9 wherein said tungsten sealant contains an epoxy, adhesive, sealer, caulk or similar material.

11. A system in accordance with claim 1, wherein said x-ray imaging system is an x-ray inspection machine for electronic devices.

12. A system in accordance with claim 1, wherein said x-ray imaging system is a medical x-ray machine.

* * * * *

UNITED STATES PATENT AND TRADEMARK OFFICE

CERTIFICATE OF CORRECTION

PATENT NO. : 6,967,343 B2
APPLICATION NO. : 10/280905
DATED : November 22, 2005
INVENTOR(S) : Batten et al.

It is certified that error appears in the above-identified patent and that said Letters Patent is hereby corrected as shown below:

On the face page, in field (57), under "Abstract", in column 2, line 6, delete "spaying" and insert -- spraying --, therefor.

In column 6, line 4, in Claim 1, after "target;" insert -- and --.

In column 6, line 18, in Claim 1, after "image" delete "said" and insert -- a --, therefor.

In column 6, line 43, in Claim 10, delete "contains" and insert -- comprises --, therefor.

Signed and Sealed this

Fourteenth Day of November, 2006

JON W. DUDAS
*Director of the United States Patent and Trademark Office*